United States Patent [19]

Gandy

[11] Patent Number: 4,692,847

[45] Date of Patent: Sep. 8, 1987

[54] ILLUMINATED AWNING ASSEMBLY

[75] Inventor: James Gandy, Mississauga, Canada

[73] Assignee: Signtech Inc., Mississauga, Canada

[21] Appl. No.: 769,825

[22] Filed: Aug. 27, 1985

Related U.S. Application Data

[63] Continuation-in-part of Ser. No. 761,286, Aug. 1, 1985, abandoned.

[51] Int. Cl.[4] ..... F21S 1/02

[52] U.S. Cl. ..... 362/152; 362/249; 362/812; 52/74; 52/222; 160/22; 160/378; 160/383; 248/345

[58] Field of Search ..... 362/152, 225, 249, 812; 52/74–78, 63, 222; 248/273, 345; 160/22, 45, 48, 83 R, 63, 237, 378, 380, 383

[56] References Cited

U.S. PATENT DOCUMENTS

| | | | |
|---|---|---|---|
| 2,640,143 | 5/1953 | Malone | 362/152 |
| 2,875,824 | 3/1959 | Rice | 160/77 |
| 3,924,365 | 12/1975 | Orberg | 52/63 |
| 4,192,112 | 3/1980 | Reilly | 52/222 |
| 4,422,491 | 12/1983 | Cusick | 160/65 |
| 4,453,558 | 6/1984 | Ochs et al. | 135/106 |

*Primary Examiner*—Craig R. Feinberg
*Assistant Examiner*—David A. Okonsky
*Attorney, Agent, or Firm*—Robert F. Delbridge; Arne I. Fors

[57] ABSTRACT

An illuminated awning assembly has a frame with an upright rear frame portion having upper and lower frame members and a pair of upright side members extending between respective opposite ends of the upper and lower frame members. A horizontal frame portion has a pair of horizontal side members extending forwardly from the respective junctions of the rear lower frame member and the upright side members, and a lower front frame member extending between front ends of the horizontal side members. A pair of further side frame members are on opposite sides of the frame, each extending from the junction of the lower front frame member and respective horizontal side frame member to the junction of the upper frame member and the respective upright side member. A sheet of translucent flexible sign material extends upwardly from the lower front frame member over the further side frame members to the upper rear frame member, and extends from the further side frame members to the horizontal side members and to the rear upright side members. The lower front frame member, the upper rear frame member, the horizontal side members and the rear upright side members each have a series of adjustable sheet tensioning devices spaced along their length. Each tensioning device comprising sheet retaining means gripping an edge portion of the sign sheet and means for adjusting the position of the gripping means relative to the member to tension the sign sheet between the respective members. Illuminating means are within the frame.

21 Claims, 13 Drawing Figures

Figure 2:
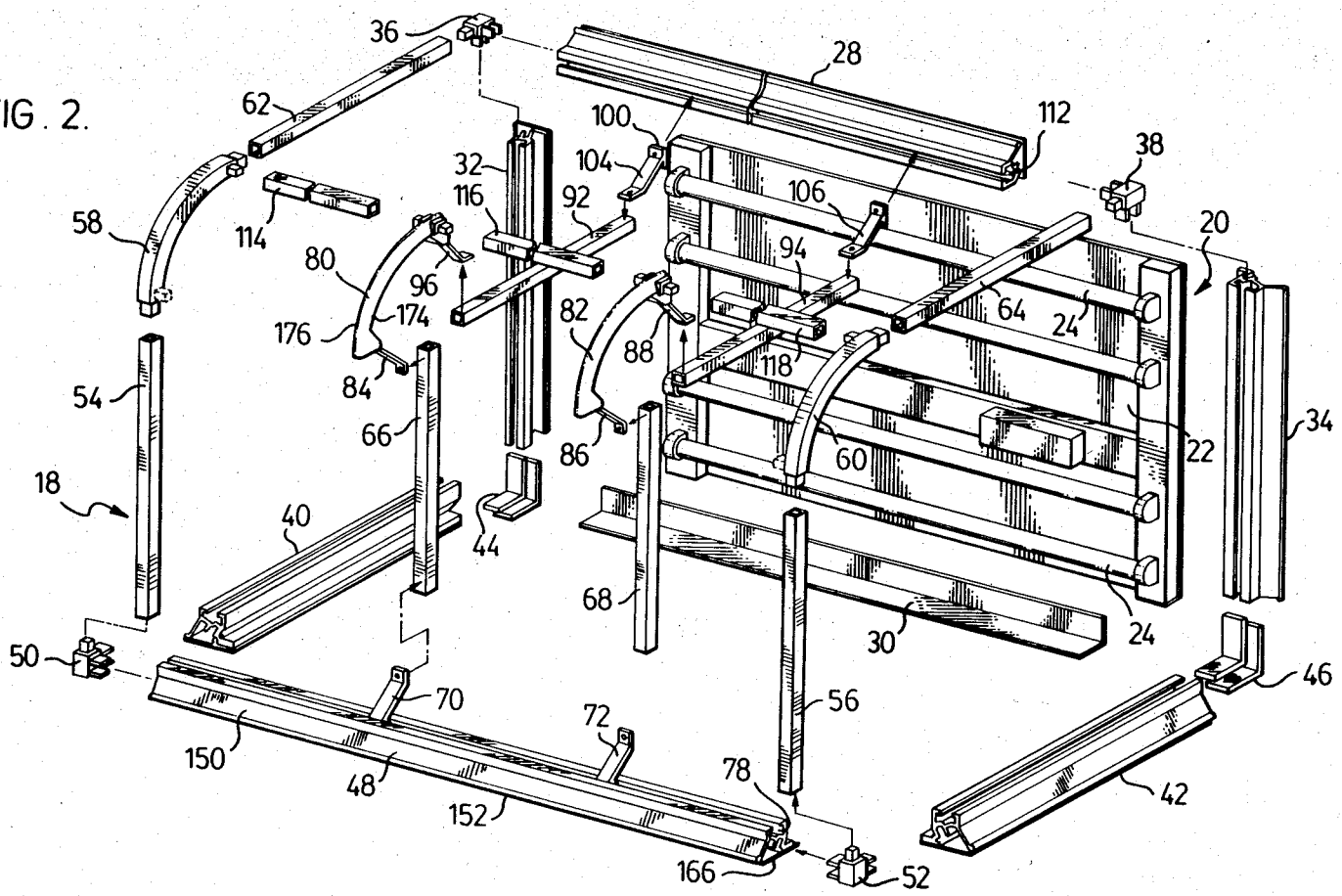

FIG. 1.
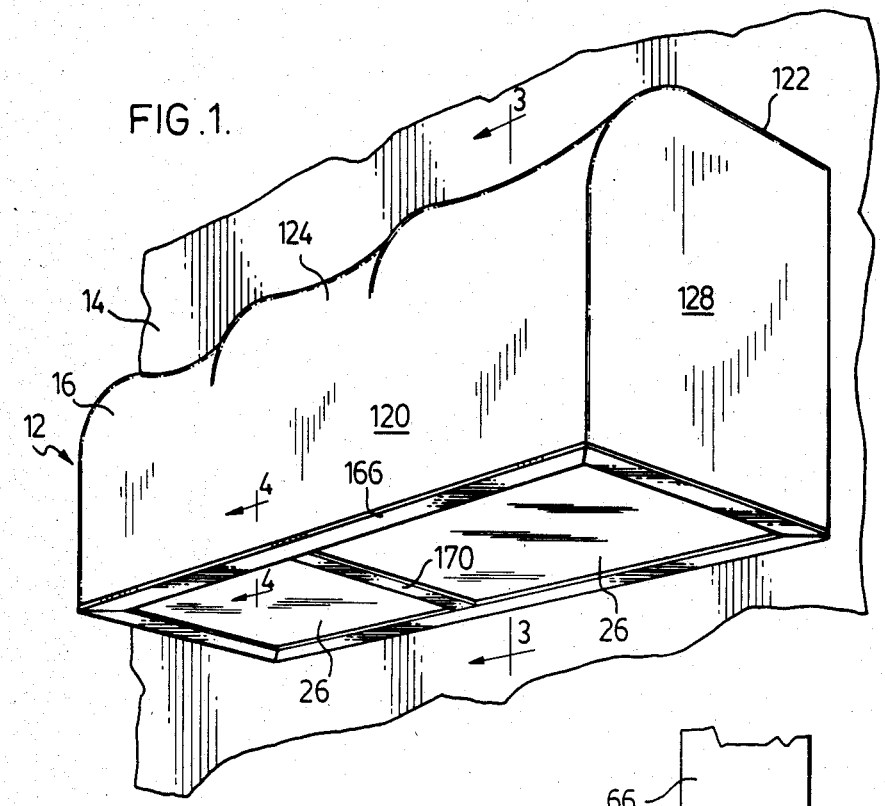
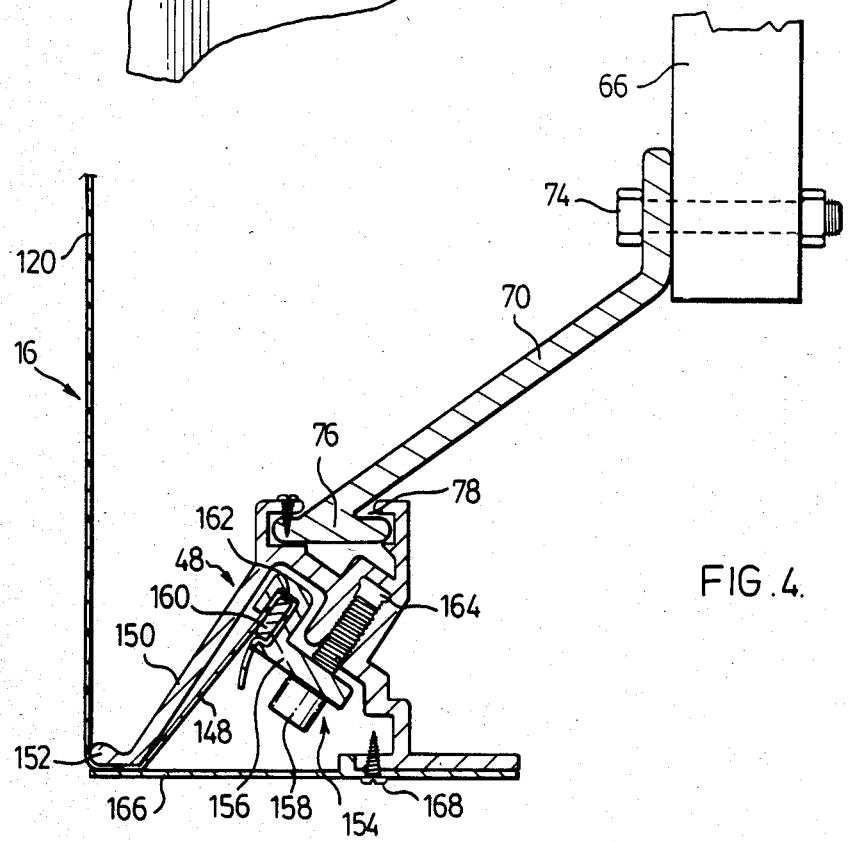
FIG. 4.

FIG. 3.
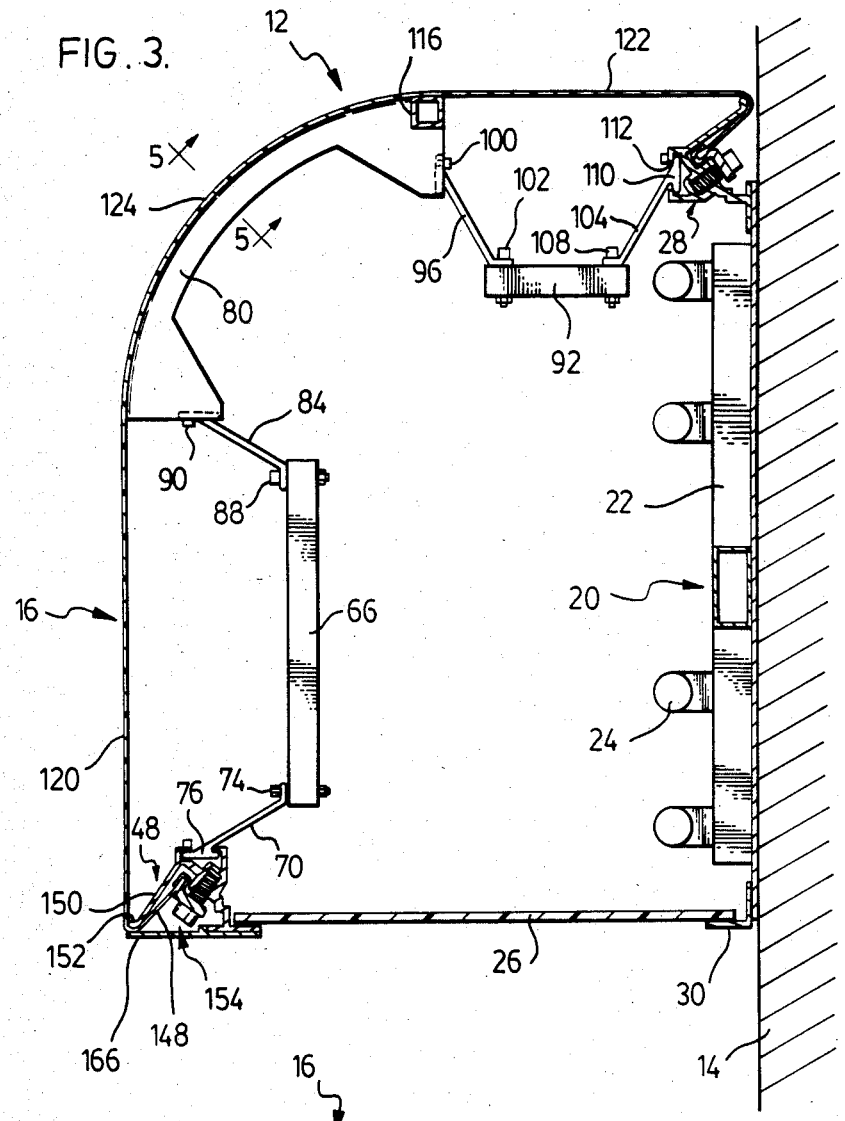
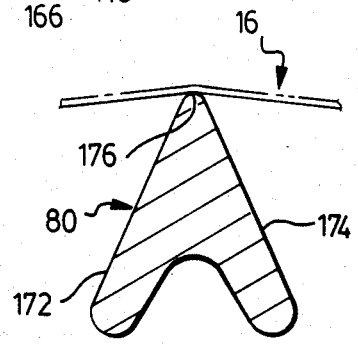
FIG. 5.

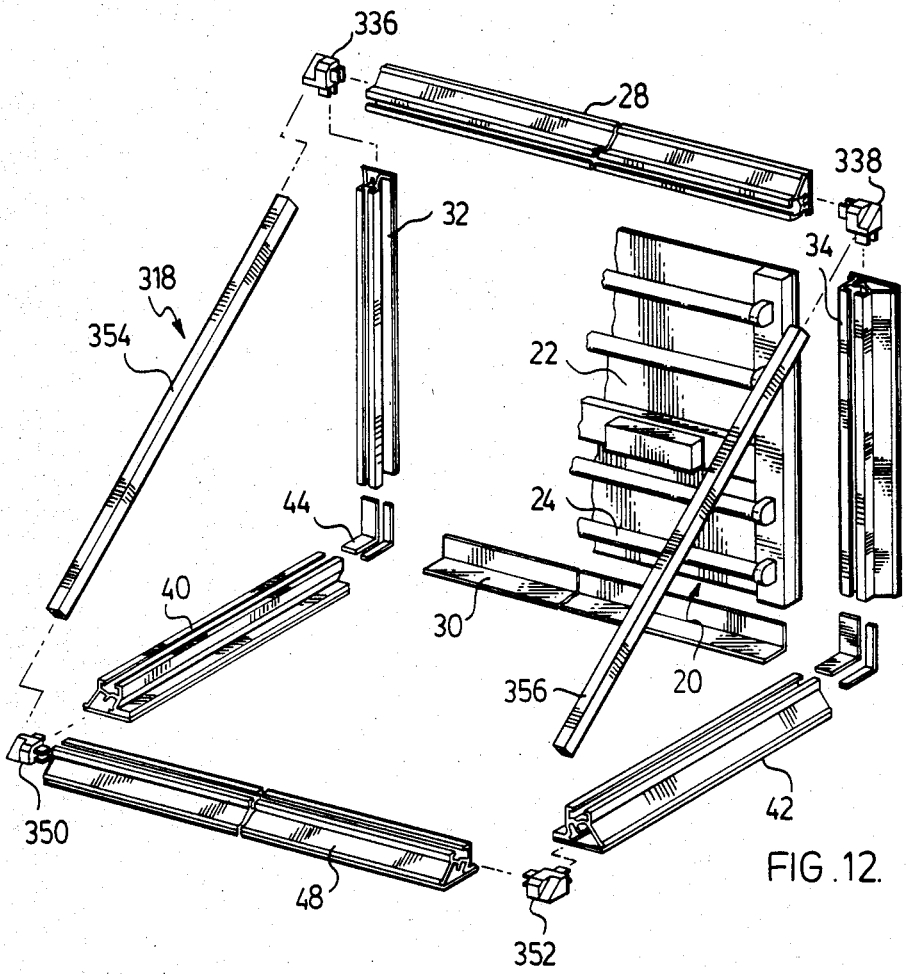
FIG. 12.
FIG. 13.
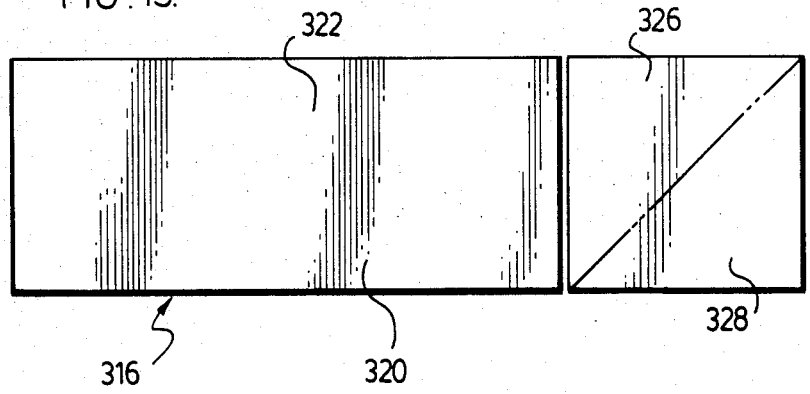

ILLUMINATED AWNING ASSEMBLY

This application is a continuation-in-part of application Ser. No. 761,286, filed Aug. 1, 1985 (now abandoned).

This invention relates to illuminated awnings which are used, for example, over the doorways and/or windows of shops, stores and restaurants.

Illuminated awnings are often used to enhance the appearance of a doorway or window of a commercial establishment and may also carry appropriate wording or decoration. Alternatively, an illuminated awning may simply be secured to a wall and provided with appropriate information and/or decoration for advertising purposes.

Known illuminated awnings are not as attractive in appearance as is desired, and it is therefore an object of the invention to provide an attractive illuminated awning which is relatively inexpensive and is easy to install.

According to the invention, as illunimated awning assembly comprises a frame having an upright rear frame portion having upper and lower frame members and a pair of upright side members extending between respective opposite ends of the upper and lower frame members, a horizontal frame portion having a pair of horizontal side members extending forwardly from the respective junctions of the rear lower frame member and the upright side members, and a lower front frame member extending between front ends of the horizontal side members, a pair of further side frame members on opposite sides of the frame, each further side frame member extending from the junction of the lower front frame member and respective horizontal side frame member to the junction of the upper frame member and the respective upright side member, a sheet of translucent flexible sign material extending upwardly from the lower frong frame member over the further side frame members to the upper rear frame member, and extending from the further side frame members to the horizontal side members and to the rear upright side members, the lower front frame member, the upper rear frame member, the horizontal side members and the rear upright side members each having a series of adjustable sheet tensioning devices spaced along their length, each tensioning device comprising sheet retaining means gripping an edge portion of the sign sheet and means for adjusting the position of the gripping means relative to the member to tension the sign sheet between the respective members, and illuminating means located within the frame.

The frame can easily be assembled, and the translucent sign sheet can be easily secured in place on the frame in a tensioned manner by means of the adjustable tensioning devices.

Each further side member may have a first portion extending upwardly substantially vertically from the junction of the lower front frame member and the respective horizontal side member, a rearwardly curved second portion extending from the top of the first portion, and a third portion extending substantially horizontally from the rear of the second portion to the junction of the upper frame member and the upright side member. The illuminated awning assembly may also have at least one intermediate frame member extending between the lower front frame member and the upper rear frame member intermediate the ends thereof, each intermediate frame member having a substantially vertical portion, means connecting the lower end of the substantially vertical portion to the lower front frame member, a curved portion in the same curved plane as the rearwardly curved second portions of the further side members, means connecting a front end of the intermediate curved portion to an upper end of the substantially horizontal portion, means connecting a front end of the substantially horizontal portion to a rear end of the curved intermediate portion, and means connecting a rear end of the substantially horizontal portion to the upper rear frame member.

The substantially vertical portion of each intermediate frame member may be in a plane rearwardly of the plane defined by the first portions of the further sub members, said sign sheet being spaced from the substantially vertical portion of the at least one intermediate frame member, and said spacing minimizing the production of shadows of said intermediate substantially vertical portion on the sign sheet by the illuminating means.

The curved portion of each intermediate frame member may have a narrow leading edge engaging the sign sheet and opposed sides diverging rearwardly from the narrow leading edge to minimize the production of shadows of the curved portion on the sign sheet by the illuminating means.

The substantially horizontal portion of each intermediate frame member may be in a plane below the plane defined by the third portions of the side frame members, the sign sheet being spaced from each substantially horizontal portion, with such spacing minimizing the production of shadows on the sign sheet by the illuminating means.

The lower front frame member, the upper rear frame member, the horizontal side members and the rear upright side members may each have a flange with a free end over which the sign sheet passes and a recess in which the sheet tensioning devices are located, each tensioning device being positioned to cause the sign sheet to turn through an angle of over 90° as the sheet passes over the respective frame flange free end. Advantageously, each tensioning device may be positioned to cause the sign sheet to turn through an angle of about 135° as the sign sheet passes over the respective flange free end.

The adjusting means of each tensioning device may comprise a bolt passing through the retaining means into a threaded aperture in the respective frame member. The illuminating means may comprise a series of vertically spaced horizontally extending fluorescent tubes at the rear of the frame. The illuminated awning assembly may also include a horizontal translucent panel extending across the bottom of the frame and secured thereto.

Each further side frame member may alternatively have a first portion extending upwardly substantially vertically from the junction of the lower front frame member and the respective horizontal side member, a second straight portion extending in an upwardly and rearwardly inclined direction from the top of the first portion, and a third portion extending substantially horizontally from the rear of the second portion to the junction of the rear upper frame member and the respective upright side member. The frame may also include an upper front frame member extending substantially horizontally from one side to the other between the junctions of the upright first portions and the second portions of the further side frame members.

At least one intermediate frame member may extend between the lower front frame member and the upper front frame member intermediate the ends thereof, each intermediate frame member having a substantially vertical portion in a plane rearwardly of the plane defined by the first portions of the further side members, means connecting the lower end of the substantially vertical portion to the lower front frame member, and means connecting the upper end of the substantially vertical portion to the upper front frame member, said sign sheet being spaced from the substantially vertical portion of the at least one intermediate frame member, and said spacing minimizing the production of shadows of said intermediate substantially vertical portion on the sign sheet by the illuminating means.

The frame may also include an upper front frame member extending substantially horizontally from one side of the frame to the other between the junctions of the second portions of the third portions of the further side frame members. At least one intermediate frame member may extend between the upper front frame member and the rear upper frame member intermediate the ends thereof, each intermediate frame member having a substantially horizontal portion in a plane below the plane defined by the third portions of the further side frame members, means connecting the front end of the horizontal portion to the upper front frame member, and means connecting the rear end of the horizontal portion to the rear upper frame member, said sign sheet being spaced from the substantially horizontal portion of the at least one intermediate frame member, and said spacing minimizing the production of shadows of said intermediate substantially horizontal portion on the sign sheet by the illuminating means.

Each further side frame member may alternatively be streight and extend in a rearwardly and upwardly inclined manner from the junction of the lower front frame member and the respective horizontal side frame member to the junction of the rear upper frame member and the respective upright side frame member.

Figure 6:
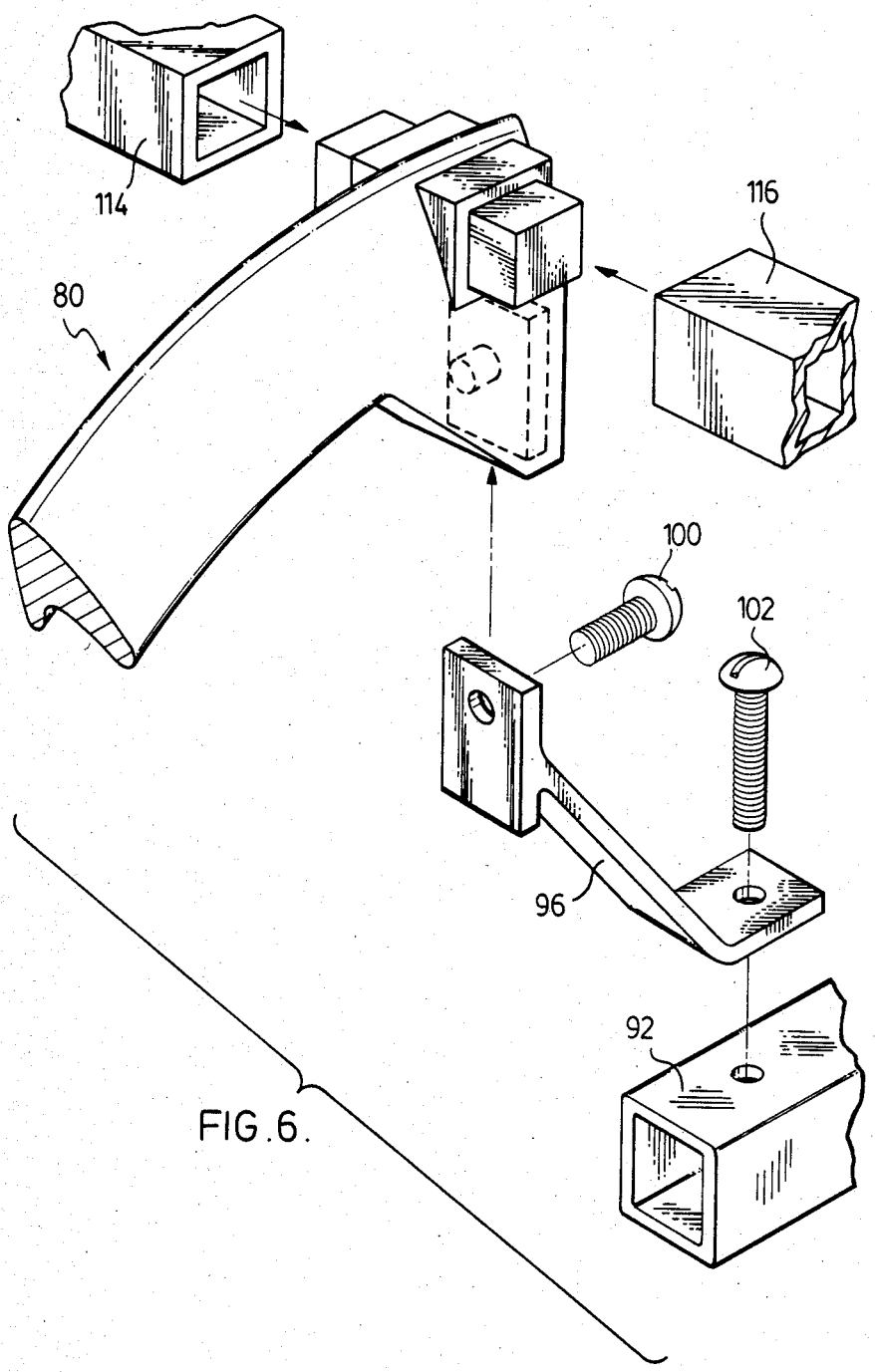
Figure 7:
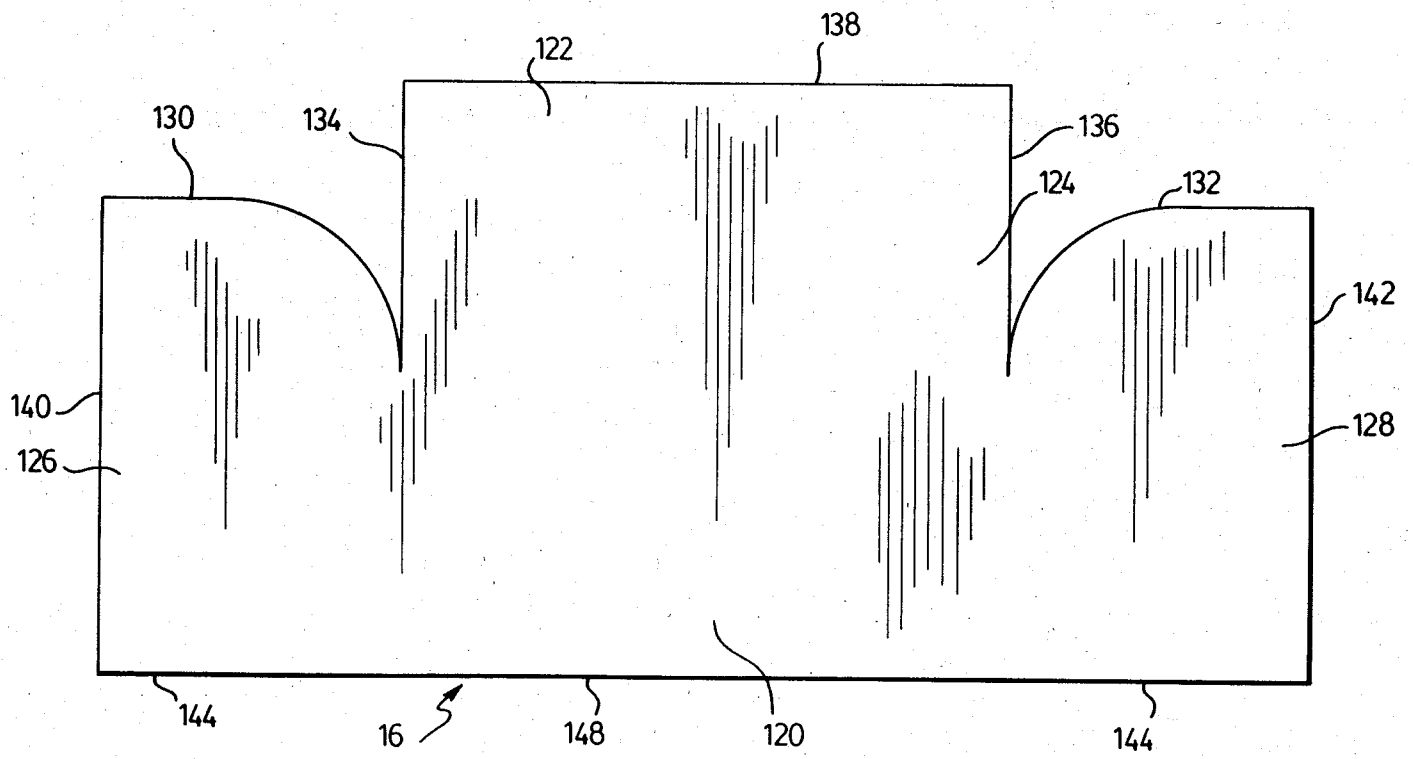
Figure 8:
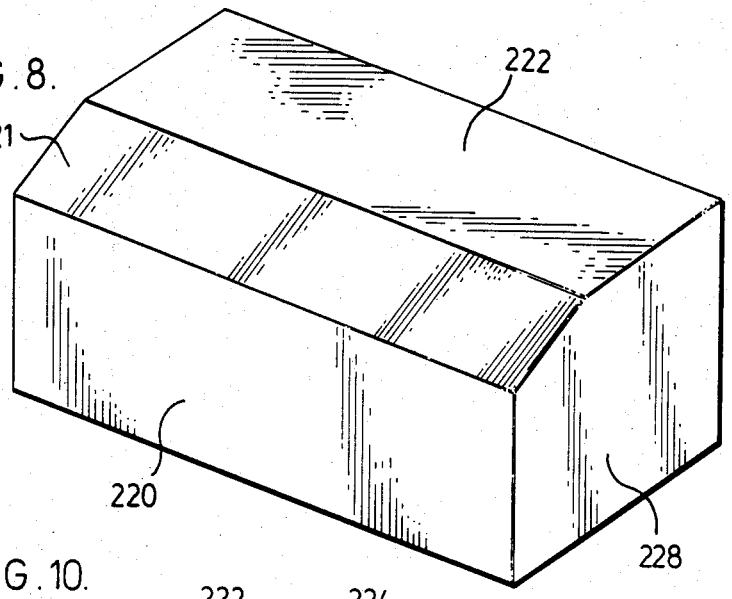
Figure 10:
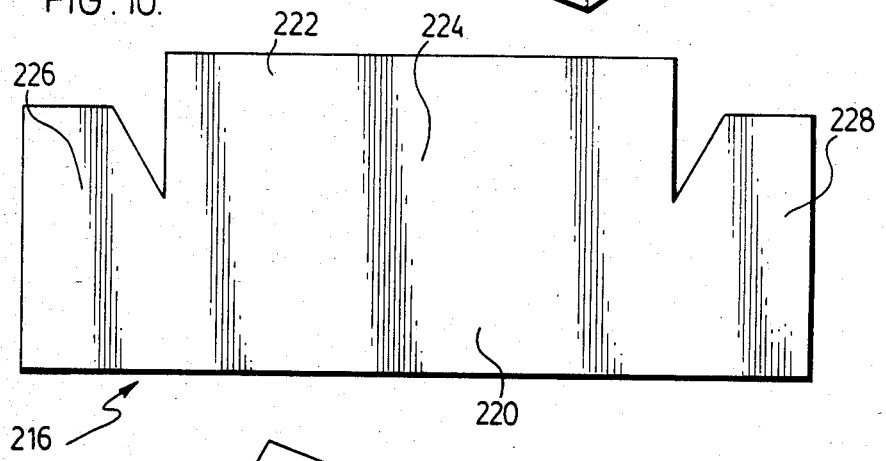
Figure 11:
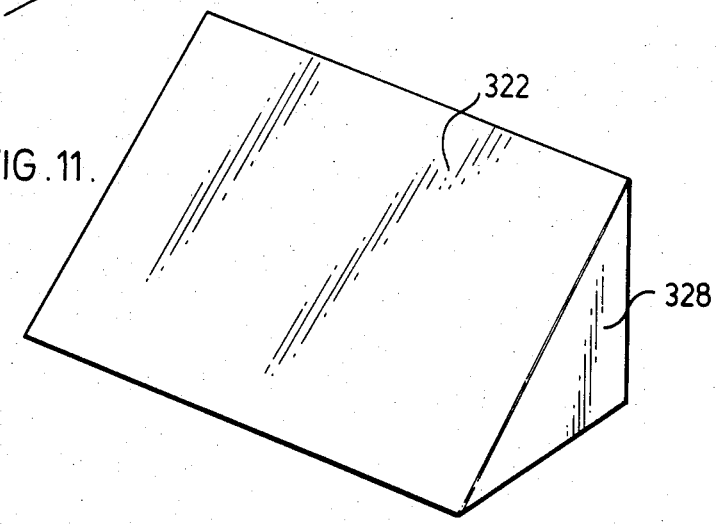
Figure 9:
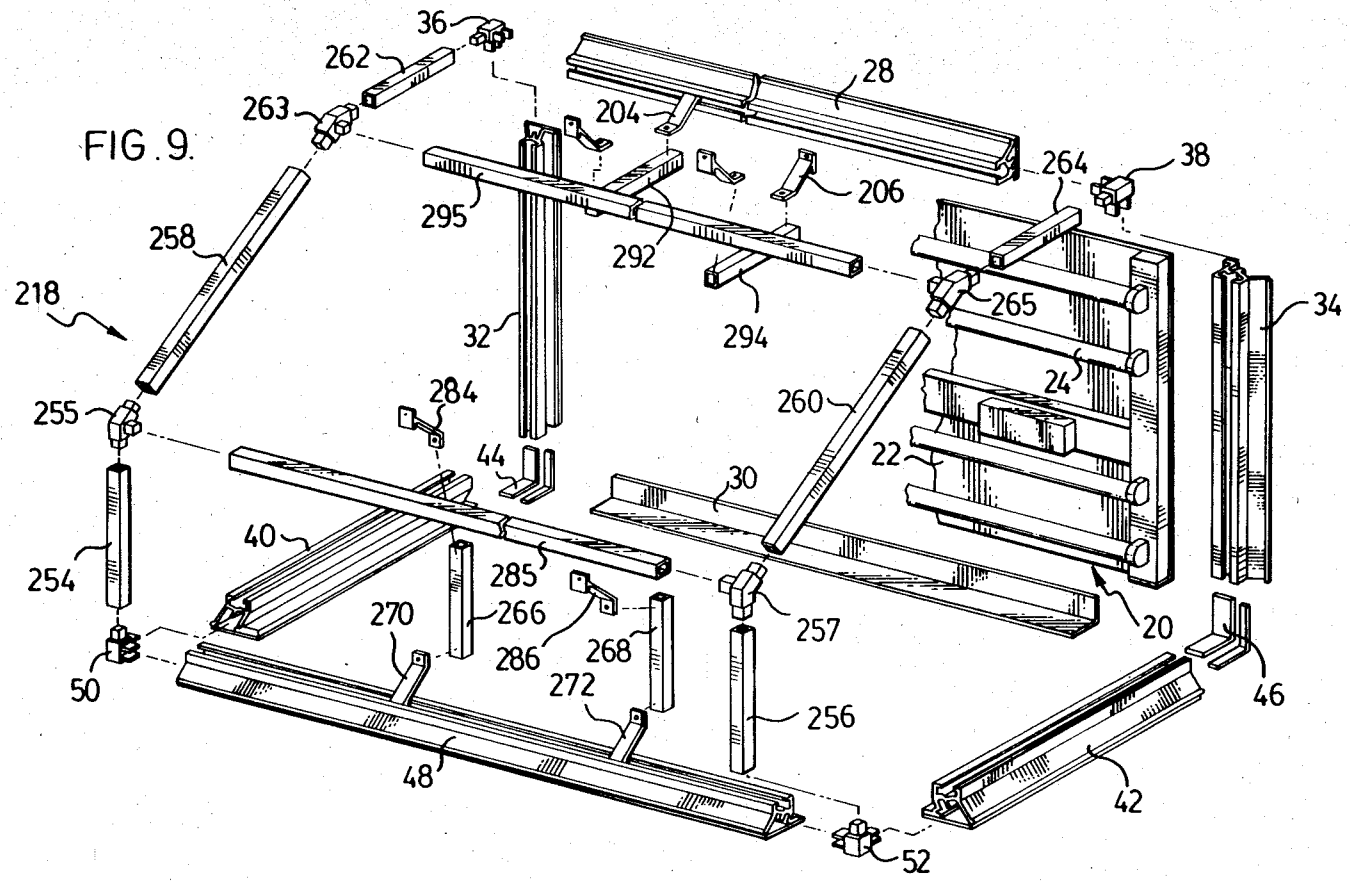

Embodiments of the invention will now be described, with reference to the accompanying drawings, of which:

FIG. 1 is a perspective view of an illuminated awning assembly in accordance with one embodiment of the invention, FIG. 2 is an exploded view of the frame and lamp arrangement, FIG. 3 is a sectional view along the line 3—3 of FIG. 1, FIG. 4 is a fragmentary sectional view along the line 4—4 of FIG. 1, FIG. 5 is a fragmentary sectional view along the line 5—5 of FIG. 3, FIG. 6 is an exploded view of an upper frong portion of the frame, FIG. 7 is a plan view of the flexible sign sheet material before installation on the frame, FIG. 8 is a perspective view of an illuminated awning assembly in accordance with a second embodiment of the invention, FIG. 9 is an exploded view of the frame and lamp arrangement of the embodiment of FIG. 8, FIG. 10 is a plan view of the flexible sign sheet material before installation on the frame shown in FIG. 9, FIG. 11 is a perspective view of an illuminated awning assembly in accordance with a third embodiment of the invention, FIG. 12 is an exploded view of the frame and illuminateing means of the embodiment of FIG. 11, and FIG. 13 is a plan view of the flexible sign sheet material before installation of the the frame of FIG. 12.

Referring to the drawing, an illuminated awning assembly 12 is secured to a vertical wall 14 in any convenient manner over a store door and/or window. The awning assembly comprises a sheet of translucent flexible sign material 16 mounted on a frame 18 in a manner which will be described in more detail later. A lamp arrangement 20 comprises a panel 22 forming the rear vertical wall of the awning assembly and four vertically spaced horizontally extending fluorescent tubular lamps 24 located in a vertical plane. A pair of translucent panels 26 form the bottom horizontal wall of the awning assembly.

The frame 18 has an upright rear frame portion with horizontal upper and lower members 28, 30 and a pair of vertical side members 32, 34 extending between respective opposite sides of the horizontal mambers 28, 30 and secured thereto by corner brackets 36, 38 respectively. A horizontal frame portion has a pair of horizontal side members 40, 42 extending forwardly from the respective junctions of the rear lower frame member 30 and the vertical side members 32, 34 with angle brackets 44, 46 being provided at their junctions. A lower front frame member 48 extends between the front ends of the horizontal side members 40, 42, being secured thereto by corner brackets 50, 52.

A pair of further side members each has a first vertical portion 54, 56 extending upwardly from the junctions of the lower frame member 48 and the respective horizontal side members 40, 42, a rearwardly curved second portion 58, 60 extending from the top of the vertical portions 54, 56, and a horizontal third portion 62, 64 extending from the rear ends of the curved second portions 58, 60 to the junctions of the upper frame member 28 and the respective side members 32, 34. As indicated in FIG. 2, the corner brackets 36, 38, 50, 52 and angle brackets 44, 46 function to secure the various previously mentioned frame members together to form the rigid frame 18.

The frame 18 also has a pair of transversely spaced intermediate frame members, each having a vertical portion 66, 68 located in a plane rearwardly of the plane defined by the vertical side members 54, 56. The lower ends of intermediate vertical portions 66, 68 are secured to the lower frame member 48 by connectors 70, 72, the upper ends of connectors 70, 72 being bolted to the lower ends of intermediate vertical portions 66, 68 by bolts 74 and their lower ends being shaped at 76 for transverse sliding engagement in a longitudinally extending recess 78 in lower front frame member 48.

Each intermediate frame member also has a curved portion 80, 82 in the same curved plane as the rearwardly curved second portions 58, 60 of the side member. The lower ends of curved portions 80, 82 are connected to the upper ends of vertical portions 66, 68 by connectors 84, 86, the lower ends of connectors 84, 86 being connected to the upper ends of vertical portions 66, 68 by bolts 88, and the upper ends of connectors 84, 86 being connected to the lower ends of curved portions 80, 82 by bolts 90. The shape and function of the curved frame portions 80 will be described in more detail later.

Each intermediate frame member also has a horizontal portion 92, 94 in a plane below that defined by the horizontal side portions 62, 64 of the side members. The front ends of the horizontal portions 92, 94 are connected to rear ends of curved portions 80, 82 by connectors 96, 98, the upper ends of connectors 96, 98 being connected to the rear ends of curved portions 80, 82 by bolts 100, and the lower ends of connectors 96, 98 being connected to the front ends of the horizontal members 92, 94 by bolts 102. The rear ends of the horizontal portions 92, 94, are connected to the upper rear horizontal member 28 by connectors 104, 106. The lower ends of connectors 104, 106 are connected to the rear ends of horizontal portions 92, 94 by bolts 108, and the upper ends of connectors 104, 106 are shaped at 110 for transverse sliding engagement in a longitudinal extending recess 112 in the upper rear horizontal member 28. The frame also includes spacers 114, 116, 118, extending between the upper rear ends of the curved portions 58, 80, 82, 60.

A sheet of translucent flexible sign material 16 is secured to the front, top and sides of the frame 18 in a manner which will now be described. The sheet 16 is a one-piece sheet having a front portion 120, a top portion 122, an upper front portion 124 between front portion 120 and top portion 122, and side portions 126, 128. In an initial assembly step, the upper edges 130, 132 of the side portions 126, 128 are secured to the side edges 134, 136 respectively of the upper front and top portions 124, 122. The respective side edges 130, 132, 134, 136, are shaped as shown in FIG. 7 so that, when the edges are secured together, the sign sheet 16 assumes the configuration shown in FIG. 1. The sign sheet 16 will normally be made of suitable plastic material, and the respective side edges may thus be secured to one another by seam welding.

The upper horizontal frame member 28, the vertical side frame members 32, 34, the horizontal side frame members 40, 42 and the lower front horizontal frame member 48 are each constructed to receive the upper edge portion 138, the vertical side edge portions 140, 142, the horizontal side edge portions 144, 146, and the front edge portion 148 respectively of the sign sheet 16. Only the attachment of the front edge sign sheet portion 148 to the lower front horizontal frame member 48 will be described in detail, it will be understood that such description also applies to the attachment of the other sign sheet edge portions to the other frame members.

As shown in FIGS. 2 to 4, the lower horizontal front frame member 48 has a downwardly and forwardly inclined flange 150. When the sign sheet 16 is fitted onto the frame 18, the front portion 120 of the sign sheet 16 extends over the front of the frame 18, with the lower edge portion 148 passing around the free end 152 of the flange 150. The sign sheet 16 is turned to an angle of 135 as it passes around the flange free end 152 so that the edge portion 148 extends upwardly and rearwardly into the interior of the frame member 48. A series of tensioning devices 154 are secured at intervals along the length of the frame member 48. Since such tensioning devices 154 are described in more detail in U.S. Pat. No. 4,542,605 issued Sept. 21, 1985, they will only be described briefly here.

Each tensioning assembly 154 comprises a sheet holder 156 and a tensioning bolt 158. The sign shet edge portion 148 passes around a retainer 160 which is slid into a recess 162 in the sheet holder 156 to hold the sheet edge portion 148 in assembly therewith. The bolt 158 passes through an aperture in the sheet holder 156 and threadingly engages the ribbed sides of a longitudinally extending recess 164 in the frame member 48. All the sheet edge portions referred to above are secured to respective frame members in the same manner so that the sign sheet 16 is evenly tensioned over the frame as shown in FIG. 1. It will be noted that the tensioning assemblies 154 are located within the periphery of the frame 18 and hence do not protrude therefrom. The tensioning assemblies 154 in the lower frame member 48 and the side frame member 40, 42 can be concealed from view below by cover strips 166 secured by screw 168 to the respective frame members.

As previously described, the illuminated awning assembly 12 can be secured to a wall 14 in any convenient manner. When the fluorescent tubes 24 are switched on, the light shines through the translucent sign material 16 and through the translucent panels 26. The translucent panels 26 are supported by the various horizontal frame members in a manner which will be readily apparent from FIG. 3, with the two panels 26 in this embodiment also resting on a central support strip 170 (see FIG. 1).

As also previously mentioned, the front intermediate vertical frame portions 66, 68 are located in a plane rearwardly of the vertical side frame portions 54, 56, and thus are rearwardly spaced from the front portion 120 of the sign sheet 16. This minimizes any shadow of the intermediate frame portions 66, 68 on the front sign sheet portion 120 which might otherwise be caused by the light from the fluorescent tubes 24. Similarly, the downward spacing of the intermediate upper frame members 92, 94 from the top portion 122 of the sign sheet 16 minimizes the production of any shadows of the frame portions 92, 94 on the sign sheet top portion 122.

The curved intermediate frame portions 80, 82 which support the curved upper front portion 124 of the sign sheet 16 are shaped to minimize any shadow of the frame portions 80, 82 on the sign sheet portion 124 by the fluorescent tubes 24. As shown in FIG. 5, each frame portion 80, 82 has opposed sides 172, 174 which diverge rearwardly from a narrow leading edge 176. Only the narrow leading edge 176 engages the sign sheet 16 as it extends from the front to the top of the frame 16, and therefore the light of the fluorescent tubes 24 is able to illuminate a maximum area of the sign sheet 16 in the region of the intermediate curve frame portions 80, 82.

FIGS. 8 to 10 show a second embodiment of the invention which is similar to the first embodiment in that its frame 218 has the same upright rear frame portion, horizontal frame portion and lamp arrangement as in the first embodiment. The same reference numerals will therefore be used to identify similar parts. The second embodiment differs from the first embodiment in the construction of the further side frame members and the intermediate frame members to give the awning a different shape, as will be evident from FIG. 8.

As shown in FIG. 9, the further side frame members have first portions 254, 256 extending upwardly substantially vertically from the junctions of the lower front frame member 48 and the respective horizontal side member 40, 42. Second straight portions 258, 260 extend in an upwardly and rearwardly inclined direction from the top of the first portions 254, 256 and are secured thereto by brackets 255, 257. A third portion 262, 264 extends substantially horizontally from the rear of the second portions 258, 260, being connected thereto by brackets 263, 265 to the junctions of the rear upper frame member 28 and the upright side members 32, 34, being connected thereto by corner brackets 36, 38.

An upright front frame member 285 rxtends substantially horizontally from one side to the other between the junctions of the upright first portions 254, 256 and the second portions 258, 260. A pair of laterally spaced intermediate frame members extend between the lower front frame member 48 and the upper front frame member 285 intermediate their ends, each intermediate frame member has a substantially vertical portion 266, 268 in a plane rearwardly of the plane defined by the first portions 254, 256 of the further side members. The lower ends of the substantially vertical intermediate portions 266,268 are connected by connectors 270, 272 to the lower front frame member 48, and their upper ends are connected by connectors 284, 286 to the upper front frame member 285.

A further upper front frame member 295 extends substantially horizontally from one side to the other between the junctions of the second portions 258, 260 and the third portions 262, 264 of the further side members. A pair of laterally spaced intermediate frame members extend between the further upper front frame member 295 and the rear upper frame member 28. Each intermediate frame member has a substantially horizontal portion 292, 294 in a plane below the plane defined by the third portions 262, 264 of the further side members. The front ends of the substantially horizontal intermediate portions 292, 294 are connected by connectors (not shown) to the further upper frame member 295, and their rear ends are connected by connectors 204, 206 to the rear upper frame member 28.

FIG. 10 shows the sheet of translucent flexible sign material 216 which is secured to the front, top and sides of the frame 218. The sign sheet 216 has a lower front portion 220, an upper front portion 224, a top portion 222 and side portions 226, 228. In an initial assembly step, the upper edges of the side portions 226, 228 are secured to the side edges of the upper front and top portions 224, 222 so that the sign sheet 216 assumes the configuration shown in FIG. 8.

The various edge portions of the sign sheet 216 are attached to the rear upper horizontal frame member 28, the vertical side frame members 32, 34, the horizontal side frame members 40, 42 and the lower front horizontal frame member 48 by tensioning devices in exactly the same manner as in the first embodiment. Spacing of the intermediate horizontal frame portions 292, 294 and the intermediate vertical frame portions 266, 268 from the sign sheet 216 minimizes the production of shadows of these frame portions on the sign sheet 216.

FIGS. 11 to 13 show a third embodiment which is similar to the first embodiment in the same manner as the second embodiment. In this third embodiment as shown in FIG. 12, the further side frame members 354, 356 of the frame 318 are straight and extend in a rearwardly and upwardly inclined manner from the junctions of the lower front frame member 48 and the horizontal side frame members 40, 42, being connected thereto by corner brackets 350, 352, to the junctions of the rear of the frame member 28 and the upright side frame members 32, 34, being connected thereto by corner brackets 336, 338.

The sheet of translucent flexible sign material 316 shown in FIG. 13 is secured to the front and sides of the frame 318. In an initial assembly step, the side portions 326, 328 are separated from one another and secured to opposite side edges of the front portion 322 so that the sign sheet 316 assumes the configuration shown in FIG. 11. The edge portions of the sign sheet 316 are attached to the rear upper horizontal frame member 28, the vertical side frame members 32, 34, the horizontal side frame members 40, 42 and the lower front horizontal frame member 48 by tensioning devices as in the previous embodiments.

The described embodiments provide extremely attractive illuminated awning assemblies which are clearly relatively inexpensive and easy to assemble. It will also be noted that wording or decoration may be provided on the translucent sign sheet.

Other embodiments of the invention will be readily apparent to a person skilled in the art, the scope of the invention being defined in the appended claims.

What I claim as new and desire to protect by Letters Patent of the United States is:

1. An illuminated awning assembly comprising a frame having:

an upright rear frame portion having upper and lower frame members and a pair of upright side members extending between respective opposite ends of the upper and lower frame members, a horizontal frame portion having a pair of horizontal side members extending forwardly from respective junctions of the rear lower frame member and the upright side members, and a lower front frame member extending between front ends of the horizontal side members, a pair of further side frame members on opposite ends of the frame, each further side frame member extending from a junction of the lower front frame member and respective horizontal side frame member to a junction of the upper frame member and the respective upright side member, a sheet of translucent flexible sign material extending upwardly from the lower front frame member over the further side frame members to the upper rear frame member, and extending from the further side frame members to the horizontal side members and to the rear upright side members, the lower front frame member, the upper rear frame member, the horizontal side members and the rear upright side members each having a series of adjustable sheet tensioning devices spaced along their length, each tensioning device comprising sheet retaining means gripping an edge portion of the sign sheet and means for adjusting the position of the gripping means relative to the member to tension the sign sheet between the respective members, the lower front frame member, the upper rear frame member, the horizontal side members and the rear upright side members each having a flange with a free end over which the sign sheet passes and a recess in which the sheet tensioning devices are located, each tensioning device being positioned to cause the sign sheet to turn through an angle of over 90 degrees as the sign sheet passes over the respective frame flange free end, and illuminating means located within the frame.

2. An illuminated awning assembly according to claim 1 wherein each further side member has a first portion extending upwardly substantially vertically from the junction of the lower front frame member and the respective horizontal side member, a rearwardly curved second portion extending from a top of the first portion, and a third portion extending substantially horizontally from a rear of the second portion to the junction of the upper rear frame member and the upright side member.

3. An illuminated awning assembly according to claim 2 also including at least one intermediate frame member extending between the lower front frame member and the upper rear frame member intermediate the ends thereof, each intermediate frame member having a substantially vertical portion, means connecting a lower end of the substantially vertical portion to the lower front frame member, a curved intermediate portion in the same curved plane as the rearwardly curved second portions of the further side members, means connecting a front end of the curved intermediate portion to an upper end of the substantially vertical portion, a substantially horizontal portion, means connecting a front end of the substantially horizontal portion to a rear end of the curved intermediate portion, and means connecting a rear end of the substantially horizontal portion to the upper rear frame member.

4. An illuminated awning assembly according to claim 3 wherein the substantially vertical portion of each intermediate frame member is in a plane rearwardly of a plane defined by the first vertical portions of the further side members, said sign sheet being spaced from the substantially vertical portion of the at least one intermediate frame member, and said spacing minimizing the production of shadows of said intermediate substantially vertical portion on the sign sheet by the illuminating means.

5. An illuminated awning assembly according to claim 3 wherein the curved portion of each intermediate frame member has a narrow leading edge engaging the sign and opposed sides diverging rearwardly from the narrow leading edge to minimize the production of shadows of the curved portion on the sign sheet by the illuminating means.

6. An illuminated awning assembly according to claim 3 wherein the substantially horizontal portion of each intermediate frame member is in a plane below a plane defined by the third horizontal portions of the further side frame members, the sign sheet being spaced from each intermediate substantially horizontal portion, with such spacing minimizing the production of the shadows on the intermediate substantially horizontal portion on the sign sheet by the illuminating means.

7. An illuminated awning assembly according to claim 1 wherein each tensioning device is positioned to cause the sign sheet to turn through an angle of about 135° as the sign sheet passes over the respective flange free end.

8. An illuminated awning assembly according to claim 1 wherein the adjusting means of each sheet tensioning device comprises a bolt passing through the retaining means into a threaded aperture in the respective frame member.

9. An illuminated awning assembly according to claim 1 wherein the illuminating means comprises a series of vertically spaced horizontally extending fluorescent tubes located in a vertical plane at the rear of the frame.

10. An illuminated awning assembly according to claim 9 also including a horizontal translucent panel extending across the bottom of the frame and secured thereto.

11. An illuminated awning assembly according to claim 1 wherein each further side frame member has a first portion extending upwardly substantially vertically from the junction of the lower front frame member and the respective horizontal side member, a second straight portion extending in an upwardly and rearwardly inclined direction from a top of the first portion, and a third portion extending substantially horizontally from a rear of the second portion to the junction of the rear upper frame member and the respective upright side member.

12. An illuminated awning assembly according to claim 11 also including an upper front frame member extending substantially horizontally from one end of the frame to the other between junctions of the upright first portions and the second portions of the further side frame members.

13. An illuminated awning assembly according to claim 12 also including at least one intermediate frame member extending between the lower front frame member and the upper front frame member intermediate the ends thereof, each intermediate frame member having a substantially vertical portion in a plane rearwardly of a plane defined by the first vertical portions of the further side members, means connecting the lower end of the substantially vertical portion to the lower front frame member, and means connecting an upper end of the substantially vertical portion to the upper front frame member, said sign sheet being spaced from the substantially vertical portion of the at least one intermediate frame member, and said spacing minimizing the production of shadows of said intermediate substantially vertical portion on the sign sheet by the illuminating means.

14. An illuminated awning assembly according to claim 11 also including an upper front frame member extending substantially horizontally from one end of the frame to the other between the junctions of the second portions and the third portions of the further side frame members.

15. An illuminated awning assembly according to claim 14 including at least one intermediate frame member extending between the upper front frame member and the rear upper frame member intermediate the ends thereof, each intermediate frame member having a substantially horizontal portion in a plane below a plane defined by the third horizontal portions of the further side frame members, means connecting a front end of the horizontal portion to the upper front frame member, and means connecting a rear end of the horizontal portion to the rear upper frame member, said sign sheet being spaced from the substantially horizontal portion of the at least one intermediate frame member, and said spacing minimizing the production of shadows of said intermediate substantially horizontal portion on the sign sheet by the illuminating means.

16. An illuminated awning assembly according to claim 1 wherein each further side frame member is straight and extends in a rearwardly and upwardly inclined manner from the junction of the lower front frame member and the respective horizontal side frame member to the junction of the rear upper frame member and the respective upright side frame member.

17. An illuminated awning assembly comprising a frame having:

an upright rear frame portion having upper and lower frame members and a pair of upright side members extending between respective opposite ends of the upper and lower frame members, a horizontal frame portion having a pair of horizontal side members extending forwardly from respective junctions of the rear lower frame member and the upright side members, and a lower front frame member extending between front ends of the horizontal side members, a pair of further side frame members on opposite ends of the frame, each further side frame member extending from a junction of the lower front frame member and respective horizontal side frame member to a junction of the upper frame member and the respective upright side member, a sheet of translucent flexible sign material extending upwardly from the lower front frame member over the further side frame members to the upper rear frame member, and extending from the further side frame members to the horizontal side members and to the rear upright side members, the lower front frame member, the upper rear frame member, the horizontal side members and the rear upright side members each having a series of adjustable sheet tensioning devices spaced along their length, each tensioning device comprising sheet retaining means gripping an edge portion of the sign sheet and means for adjusting the position of the gripping means relative to the member to tension the sign sheet between the respective members, illuminating means located within the frame, each further side member having a first portion extending upwardly substantially vertically from the junction of the lower front frame member and the respective horizontal side member, a rearwardly curved second portion extending from a top of the first portion, and a third portion extending substantially horizontally from a rear of the second portion to the junction of the upper rear frame member and the upright side member, and at least one intermediate frame member extending between the lower front frame member and the upper rear frame member intermediate the ends thereof, each intermediate frame member having a substantially vertical portion, means connecting a lower end of the substantially vertical portion to the lower front frame member, a curved intermediate portion in the same curved plane as the rearwardly curved second portions of the further side members, means connecting a front end of the curved intermediate portion to an upper end of the substantially vertical portion, a substantially horizontal portion, means connecting a front end of a substantially horizontal portion to a rear end of the curved intermediate portion, and means connecting a rear end of the substantially horizontal portion to the upper rear frame member, the substantially vertical portion of each intermediate frame member being in a plane rearwardly of a plane defined by the first vertical portions of the further side members, said sign sheet being spaced from the substantially vertical portion of the at least one intermediate frame member, and said spacing minimizing the production of shadows of said intermediate substantially vertical portion on the sign sheet by the illuminating means.

18. An illuminated awning assembly comprising a frame having:

an upright rear frame portion having upper and lower frame members and a pair of upright side members extending between respective opposite ends of the upper and lower frame members, a horizontal frame portion having a pair of horizontal side members extending forwardly from respective junctions of the rear lower frame member and the upright side members, and a lower front frame member extending between front ends of the horizontal side members, a pair of further side frame members on opposite ends of the frame, each further side frame member extending from a junction of the lower front frame member and respective horizontal side frame member to a junction of the upper frame member and the respective upright side member, a sheet of translucent flexible sign material extending upwardly from the lower front frame member over the further side frame members to the upper rear frame member, and extending from the further side frame members to the horizontal side members and to the rear upright side members, the lower front frame member, the upper rear frame member, the horizontal side members and the rear upright side members each having a series of adjustable sheet tensioning devices spaced along their length, each tensioning device comprising sheet retaining means gripping an edge portion of the sign sheet and means for adjusting the position of the gripping means relative to the member to tension the sign sheet between the respective members, illuminating means located within the frame, each further side member having a first portion extensing upwardly substantially vertically from the junction of the lower front frame member and the respective horizontal side member, a rearwardly curved second portion extending from a top of the first portion, and a third portion extending substantially horizontally from a rear of the second portion to the junction of the upper rear frame member and the upright side member, and at least one intermediate frame member extending between the lower front frame member and the upper rear frame member intermediate the ends thereof, each intermediate frame member having a substantially vertical portion, means connecting a lower end of the substantially vertical portion to the lower front frame member, a curved intermediate portion in the same curved plane as the rearwardly curved second portions of the further side members, means connecting a front end of the curved intermediate portion to an upper end of the substantially vertical portion, a substantially horizontal portion, means connecting a front end of a substantially horizontal portion to a rear end of the substantially horizontal portion to the upper rear frame member, the substantially horizontal portion of each intermediate frame member being in a plane below a plane defined by the third horizontal portions of the further side frame members, the sign sheet being spaced from each intermediate substantially horizontal portion, with such spacing minimizing the production of the shadows on the intermediate substantially horizontal portion on the sign sheet by the illuminating means.

19. An illuminated awning assembly comprising a frame having:

an upright rear frame portion having upper and lower frame members and a pair of upright side members extending between respective opposite ends of the upper and lower frame members, a horizontal frame portion having a pair of horizontal side members extending forwardly from respective junctions of the rear lower frame member and the upright side members, and a lower front frame member extending between front ends of the horizontal side members, a pair of further side frame members on opposite ends of the frame, each further side frame member extending from a junction of the lower front frame member and respective horizontal side frame member to a junction of the upper frame member and the respective upright side member, a sheet of translucent flexible sign material extending upwardly from the lower front frame member over the further side frame members to the upper rear frame member, and extending from the further side frame members to the horizontal side members and to the rear upright side members, the lower front frame member, the upper rear frame member, the horizontal side members and the rear upright side members each having a series of adjustable sheet tensioning devices spaced along their length, each tensioning device comprising sheet retaining means gripping an edge portion of the sign sheet and means for adjusting the position of the gripping means relative to the member to tension the sign sheet between the respective members, illuminating means located within the frame, each further side frame member having a first portion extending upwardly substantially vertically from the junction of the lower front frame member and the respective horizontal side member, a second straight portion extending in an upwardly and rearwardly inclined direction from a top of the first portion, and a third portion extending substantially horizontally from a rear of the second portion to the junction of the rear upper frame member and the respective upright side member, an upper front frame member extending substantially horizontally from one end of the frame to the other between junctions of the upright first portions and the second portions of the further side frame members, and at least one intermediate frame member extending between the lower front frame member and the upper front frame member intermediate the ends thereof, each intermediate frame member having a substantially vertical portion in a plane rearwardly of a plane defined by the first vertical portions of the further side members, means connecting a lower end of the substantially vertical portion to the lower front frame member, and means connecting an upper end of the substantially vertical portion to the upper front frame member, said sign sheet being spaced from the substantially vertical portion of the at least one intermediate frame member, and said spacing minimizing the production of shadows of said intermediate substantially vertical portion on the sign sheet by the illuminating means.

20. An illuminated awning assembly comprising a frame having:

an upright rear frame portion having upper and lower frame members and a pair of upright side members extending between respective opposite ends of the upper and lower frame members, a horizontal frame portion having a pair of horizontal side members extending forwardly from respective junctions of the rear lower frame member and the upright side members, and a lower front frame member extending between front ends of the horizontal side members, a pair of further side frame members on opposite ends of the frame, each further side frame member extending from a junction of the lower front frame member and respective horizontal side frame member to a junction of the upper frame member and the respective upright side member, a sheet of translucent flexible sign material extending upwardly from the lower front frame member over the further side frame members to the upper rear frame member, and extending from the further side frame members to the horizontal side members and to the rear upright side members, the lower front frame member, the upper rear frame member, the horizontal side members and the rear upright side members each having a series of adjustable sheet tensioning devices spaced along their length, each tensioning device comprising sheet retaining means gripping an edge portion of the sign sheet and means for adjusting the position of the gripping means relative to the member to tension the sign sheet between the respective members, illuminating means located within the frame, each further side frame member having a first portion extending upwardly substantially vertically from the junction of the lower front frame member and the respective horizontal side member, a second straight portion extending in an upwardly and rearwardly inclined direction from a top of the first portion, and a third portion extending substantially horizontally from a rear of the second portion to the junction of the rear upper frame member and the respective upright side member, an upper front frame member extending substantially horizontally from one end of the frame to the other between junctions of the second portions and the third portions of the further side frame members, and at least one intermediate frame member extending between the upper front frame member and the rear upper frame member intermediate the ends thereof, each intermediate frame member having a substantially horizontal portion in a plane below a plane defined by the third horizontal portions of the further side frame members, means connecting a front end of the horizontal portion to the upper front frame member, and means connecting a rear end of the horizontal portion to the rear upper frame member, said sign sheet being spaced from the substantially horizontal portion of the at least one intermediate frame member, and said spacing minimizing the production of shadows of said intermediate substantially horizontal portion on the sign sheet by the illuminating means.

21. An illuminated awning assembly comprising a frame having:

an upright rear frame portion having upper and lower frame members and a pair of upright side members extending between respective opposite ends of the upper and lower frame members, a horizontal frame portion having a pair of horizontal side members extending forwardly from respective junctions of the rear lower frame member and the upright side members, and a lower front frame member extending between front ends of the horizontal side members, a pair of further side frame members on opposite ends of the frame, each further side frame member extending from a junction of the lower front frame member and respective horizontal side frame member to a junction of the upper frame member and the respective upright side member, a sheet of translucent flexible sign material extending upwardly from the lower front frame member over the further side frame members to the upper rear frame member, and extending from the further side frame members to the horizontal side members and to the rear upright side members, the lower front frame member, the upper rear frame member, the horizontal side members and the rear upright side members each having a series of adjustable sheet tensioning devices spaced along their length, each tensioning device comprising sheet retaining means gripping an edge portion of the sign sheet and means for adjusting the position of the gripping means relative to the member to tension the sign sheet between the respective members, illuminating means located within the frame, illuminating means comprising a series of vertically spaced horizontally extending fluorescent tubes located in a vertical plane at the rear of the frame, and a horizontal translucent panel extending across the bottom of the frame and secured thereto.

* * * * *